US008176910B2

(12) United States Patent
O'Connell et al.

(10) Patent No.: US 8,176,910 B2
(45) Date of Patent: May 15, 2012

(54) PARASOL HEATER WITH TILTING PARASOL

(76) Inventors: Stewart O'Connell, Co. Wicklow (IE); Joseph O'Connell, Co. Wicklow (IE)

( * ) Notice: Subject to any disclaimer, the term of this patent is extended or adjusted under 35 U.S.C. 154(b) by 433 days.

(21) Appl. No.: 12/464,178

(22) Filed: May 12, 2009

(65) Prior Publication Data

US 2010/0288268 A1 Nov. 18, 2010

(51) Int. Cl.
*F24C 3/04* (2006.01)
*F24C 15/22* (2006.01)

(52) U.S. Cl. ..... 126/92 B; 126/92 AC

(58) Field of Classification Search ..... 126/92 AC, 126/92 B

See application file for complete search history.

(56) References Cited

U.S. PATENT DOCUMENTS 371,453 A * 10/1887 Hawkes ..... 182/209
3,310,047 A * 3/1967 Budden ..... 126/92 B
3,726,501 A * 4/1973 Trentmann ..... 248/351
4,569,329 A * 2/1986 Cherryholmes ..... 126/92 B
5,588,420 A * 12/1996 Dickson ..... 126/25 R
6,869,278 B2 * 3/2005 Streit ..... 431/125
7,147,277 B1 * 12/2006 Miller ..... 297/19
2007/0101983 A1 * 5/2007 Yao ..... 126/92 B

FOREIGN PATENT DOCUMENTS

DE 102004034148 A1 2/2006
EP 1310738 A1 * 5/2003
IE S2007/0277 * 1/2008
IE S84796 1/2008

* cited by examiner

*Primary Examiner* — Kenneth Rinehart
*Assistant Examiner* — Joanna Davis
(74) *Attorney, Agent, or Firm* — Seyfarth Shaw LLP; Brian Michaelis

(57) ABSTRACT

A parasol heater comprising a moveable dish provided above a gas burner, wherein the dish is pivotably coupled to a first side of the burner, the heater comprising an actuator coupled to the dish and configured in use to effect movement of the dish relative to the gas burner, the actuator extending downwardly from the dish along a second side of the burner, the second side being opposite to the first side.

14 Claims, 5 Drawing Sheets

PARASOL HEATER WITH TILTING PARASOL

FIELD OF INVENTION

The present invention relates to outdoor or patio heaters, normally gas-fired, known generally as parasol heaters, in particular to a parasol heater in which the parasol may be tilted.

BACKGROUND TO THE INVENTION

Most parasol heaters available today comprise a generally cylindrical base which may be used as a housing for a bottle or cylinder of butane or propane gas, a shaft extending upwardly from the housing for supporting a gas burner element, and a heat reflective dish or parasol supported above the burner, designed to throw heat downwards in an area around the base. The gas burner element may alternatively be any radiant heat element, including an electric radiant element. The problem with this design is exemplified in the schematic of FIG. 1 where it is evident that such heaters having a fixed parasol dish reflect the heat directly downwards to provide a reflected heat footprint, shown as the stippled area, forming a relatively small, generally circular region around the base of the heater. In this way the region where most heat is produced is immediately over the base, so that persons sitting around the base, which often has a table built over it, are not in fact in the region of maximum heat. This design is really more efficient at heating the area of the top table surface than the area around the table, or directly under the table, in effect. This problem has been addressed in one example by providing auxiliary heating elements under the table area, or around the sides of the base, providing a leg/foot warmer for persons sitting at a table over the base.

By tilting the parasol at an angle to the burner, it is possible to reflect heat produced by the burner downwardly and to one side of the base. Therefore persons standing or seated to one side of the parasol heater would receive much more direct heat from the heater. The circular table over the base could more easily be replaced by different table configurations or seating arrangements in a restaurant or patio setting where the parasol heater is to be used.

DE-102004034148 (F. Polzer GmbH) describes a parasol heater with a tilting parasol dish, in which the dish is mounted on simple hinged mounting which is centrally disposed above the gas burner element. The parasol dish is only capable of tilting at an angle, about one axis. The disadvantage of this arrangement is that when tilted to an angle of about 30°, the underside of the parasol dish contacts the top of the gas burner which restricts any further tilting movement. This means that heat still cannot be reflected very far from the base and the region immediately surrounding the base. The hinge mounting could be spaced more above the top of the burner, to let the parasol dish clear the burner when tilted, but the problem with this is that it would have to be spaced by at distance corresponding to at least the radius of the dish, making such an arrangement impractical, because the underside of the parasol dish has to be kept as close as possible to the top of the gas burner to stop heat escaping upwards and to efficiently reflect it downwards. FIG. 2 shows how a prior art parasol heater with a simple hinging parasol dish such as that described in DE-102004034148, provides a reflected heat footprint forming an ellipse, that extends over the base of the heater, and to one side, but only in a limited fashion, when fully tilted Irish Patent No. S84796 describes an improvement to this arrangement whereby the parasol dish is connected to the radiant heat element by a mounting comprising a linkage which is adapted to allow the parasol dish to move in an arc over a side edge of the radiant heat element, whereby in use heat may be reflected therefrom in a parabola. As is evident from an inspection of FIGS. 3 to 5 such a parasol heater has a reflected heat footprint, which in contrast to the prior art arrangements of FIGS. 1 and 2, extends completely to one side of the base of the heater, in a parabola.

FIGS. 4 and 5 of S84796 replicated herein show how such an arrangement comprises a parasol heater having a base portion 10, a shaft portion 20, and a gas burner element 30. The parasol dish 40 is arranged on a four point hinge mounting 50 located to one side of the top of the gas burner 30. The four point hinge mounting 50 comprises a lower hinge bar 51, spaced from a lower hinge bar 52, both hingedly affixed to the top of the gas burner 30. A pair of crank arms 53 is pivotable with the lower hinge bar 51, and supports an upper hinge bar 54. The hinge bar 54 is hingedly affixed to one side of a triangular mounting bracket 55 on the underside of the parasol dish, as seen in FIG. 4. A connecting rod 56 completes the four point linkage, being hingedly fixed at one end 56*a* to the lower hinge bar 52, and at its other end 56*b* to an apex of the triangular bracket 55. The end 56*b* may in an alternative embodiment be slidably mounted in a fixed track or channel.

A mechanism provided on the same side of the burner 30 as the hinge mounting 50 is provided to cause the lower hinge bar 52 to rotate, which in turn causes the whole four point linkage to move to tilt the parasol dish 40 with respect to the gas burner 30. The lower hinge bar 51 carries a toothed gear 57 arranged to mesh with a worm gear 58 at the top of an operating rod handle 59. The user can twist the bottom of the handle 59, even when the gas burner is lit, to rotate the worm gear which causes the four point linkage to move and tilt the parasol dish to the desired angle. The gears 57, 58 provide a ratchet mechanism which resists further tilting of the dish unless the twist handle 59 is operated.

It is evident that the arrangement of S84796 advantageously allows for the focusing of heat generated by the burner at specific locations relative to the burner. However the mechanism by which the parasol dish is moved suffers from a number of disadvantages. Firstly, while it suggests that the user can twist the handle to move the parasol dish to a desired position even when the burner is lit, it has been found that the actuation of the worm gear linkage to effect any appreciable movement of the parasol requires an extended period of time. At all times during this actuation the user is very close to the burner and this can result in the user being exposed to too much heat for too long a time, thereby becoming very uncomfortable.

It has also been found that the use of the ratchet mechanism suffers in that on heating, the toothed gear 57 and worm gear 58 expand thereby restricting their relative movement to one another. This loss of smooth interaction can only be solved by turning the heater off and allowing it to cool sufficiently. In this way the ability to move the parasol heater during operation of the burner is reduced.

It will be further appreciated that such parasol heaters are intended for use in an outdoor environment. In such environments they become exposed to ambient conditions and unless the gearing mechanisms are fabricated from expensive rust resistant materials they can corrode or otherwise degrade through the exposure to inclement weather.

The present invention seeks to overcome the disadvantages with the prior art and to provide a parasol heater with a tilting parasol dish which reflects heat downwardly and to one side in the most efficient manner.

SUMMARY OF THE INVENTION

The present invention provides an improved parasol heater with a tilting parasol dish in accordance with the claims which follow.

DETAILED DESCRIPTION OF PREFERRED EMBODIMENTS OF THE INVENTION

FIG. 1 to FIG. 5 have been described with reference to the prior art in the Background portion of the instant application.

Figure 4:
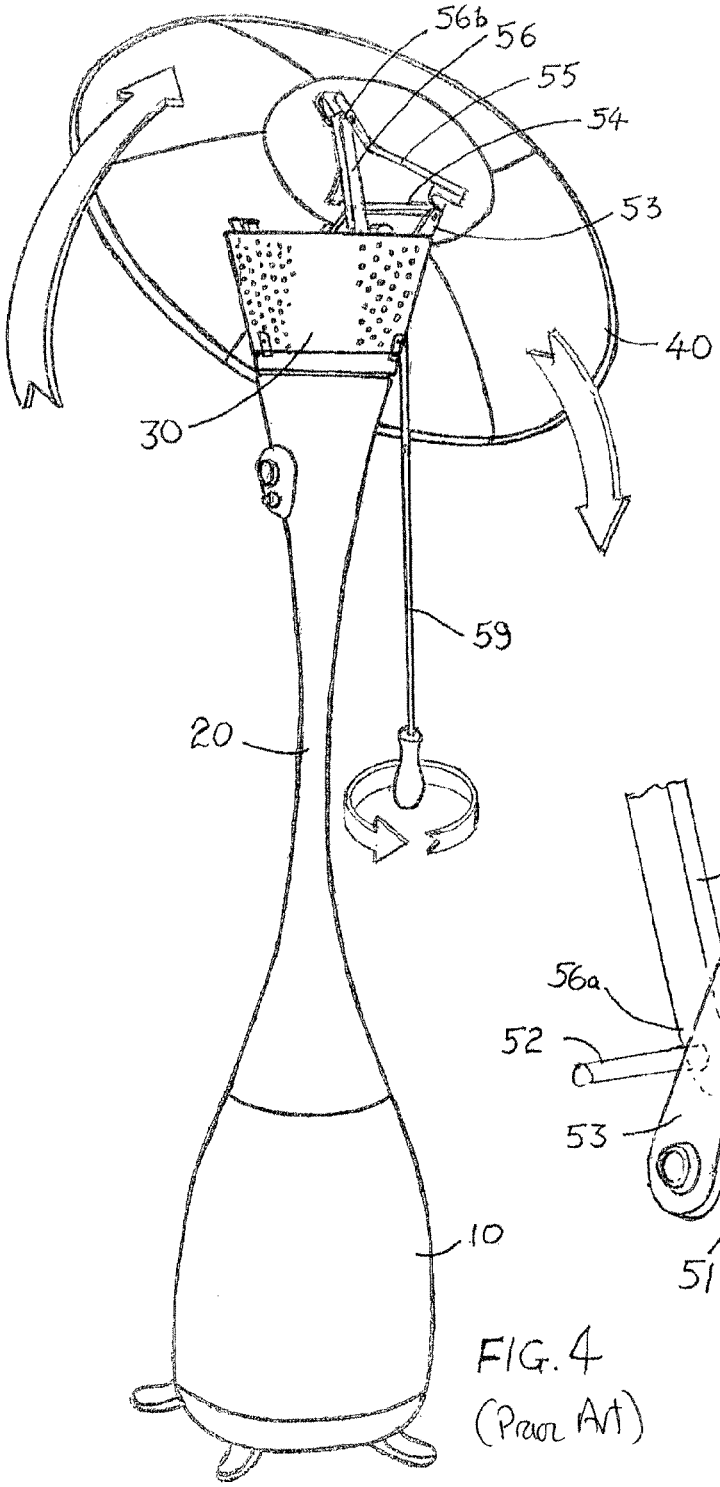
FIG. 4 (Prior Art)
FIG. 4 is a perspective view of a prior art parasol heater with a tilting parasol dish wherein the handle is provided on the same side of the burner as the tilting mechanism.
Figure 5:
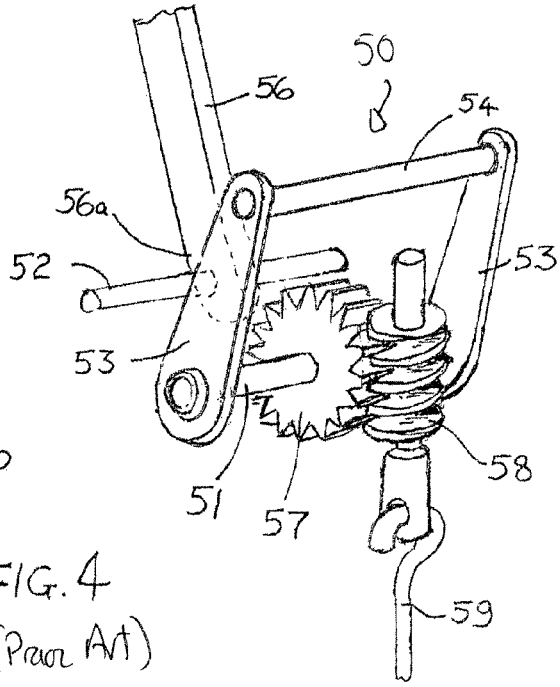
FIG. 5 (Prior Art)
FIG. 5 is an enlarged detail of the prior art tilting mechanism, hidden from view in FIG. 4.
Figure 6:
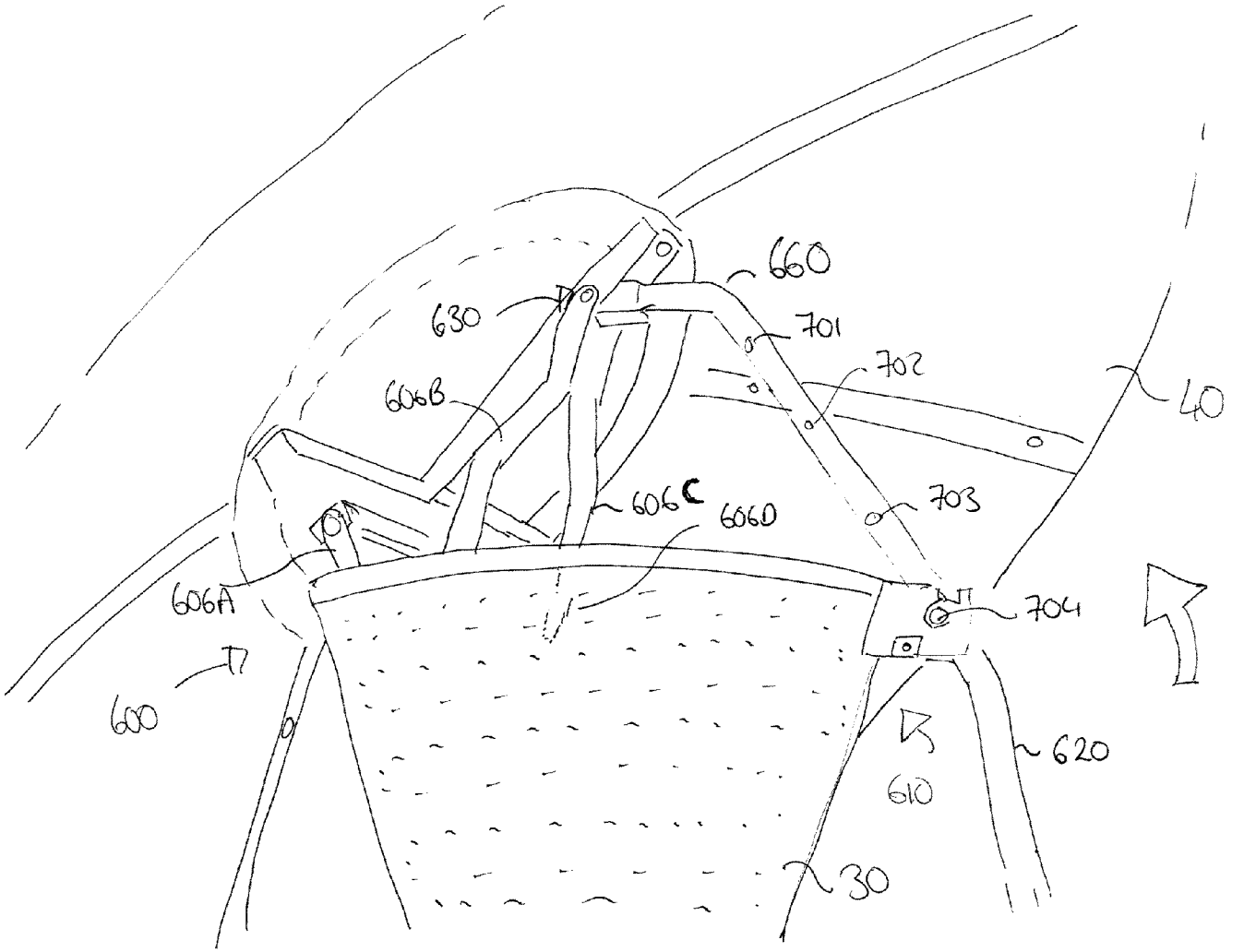
FIG. 6 is a perspective view of a tilting mechanism that may be employed within the teaching of the present invention.

FIG. 6 shows an actuation mechanism that may be employed within the context of the present invention to address some of the problems associated with the parasol heater described with reference to FIGS. 4 and 5. While the four point linkage tilting mechanism described with reference to those Figures could be usefully employed to enable the parasol dish to tilt at an angle, about more than one axis, so as to ride down over the side edge of the top of the gas burner in an arc, maintaining the necessary close spacing of the underside of the dish and the top of the burner, but providing clearance when the dish tilts back past an angle of about 30°, in this arrangement the previous difficulty associated with the actuation mechanism for causing that tilting is obviated.

In accordance with the teaching of the present invention, a parasol dish 40 is hingeably or pivotably coupled to a first side 600 of the burner 30 and the user effects movement by biasing the parasol from a second opposing side 610 of the burner 30. Similarly to the arrangement of FIG. 5, a four point linkage is employed which allows the parasol dish 40 to move in an arc relative to the burner 30 to which it is coupled. The use of this exemplary four point linkage 605 provides for four direct couplings 606A, 606B, 606C, 606D between the parasol dish 40 and the a coupling mount 607 which is provided at the first side 600 of the burner 30. Each of the four couplings 606A, 606B, 606C, 606D are desirably pivotable relative to both the dish 40 and the coupling mount 607. In this arrangement the four couplings may be considered as forming two sets of couplings, each set having two couplings. The length of the first set 606A, 606D is desirably shorter than the length of the second set 606B, 606C. In this way the first set 606A, 660D engages with the dish at a location closer to the coupling mount 607 than the second set 606C, 606B.

In contrast to the screw mechanism previously employed, in this arrangement movement of the dish is effected by direct movement of an actuator in the form of a handle 620 which is coupled to or engages with the dish 40. The handle is desirably pivotably coupled to the dish via a coupling arrangement 630 that allows for relative movement of the dish 40 and handle 620. In this way when the handle is biased upwardly by user action, movement of the handle will effect a corresponding movement of the dish 40. The handle 620 is desirably coupled to the dish at a location coincident with the coupling of the second set of couplings 606C, 606D. This serves to minimize the number of pivot points required as a first pivot pin 631 could be used for the coupling of components of the linkage 605 (which may not necessarily be a four point linkage) and the handle 620 to the dish 40.

It is evident that in this arrangement the actuator for causing the movement of the dish 40, in this exemplary arrangement a handle 620, is coupled directly to the dish 40 and is coupled above the burner 30. A portion of the handle 620 extends directly above the burner 30 and then extends downwardly along a side of the burner 30 to a distance sufficient to allow a user to the side of the heater to hold a grip portion 640 of the handle 620 to effect the movement. In contrast to the screw mechanism, in accordance with the present teaching, the handle is provided to the opposite side of the burner to the coupling mount 607 which connects the linkage to the burner 30.

Figure 7:
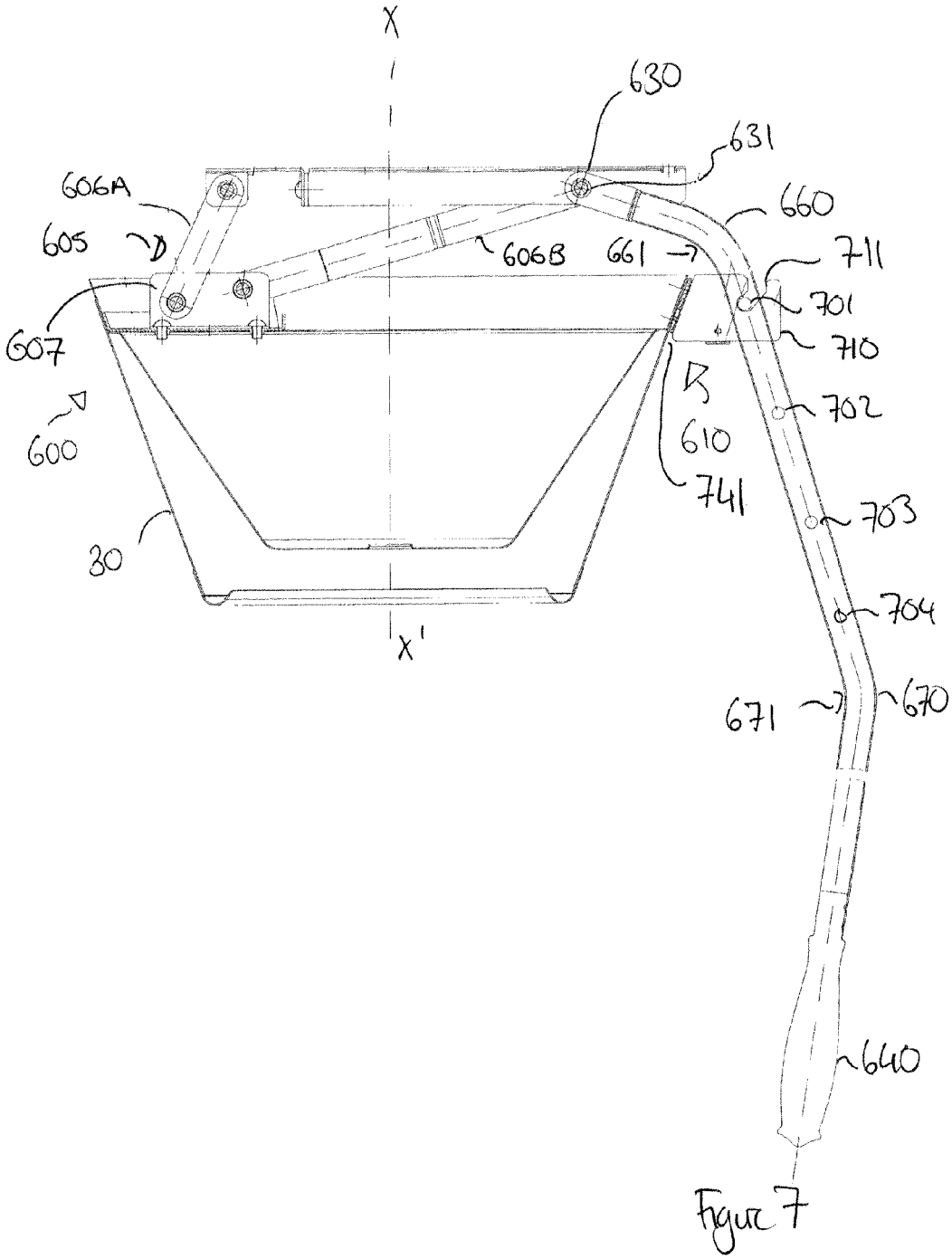
FIG. 7 is a side view of the arrangement of FIG. 6.

So as to ensure that the handle does not project too far out from the longitudinal axis X-X' of the heater, the handle is desirably not a straight handle but desirably is provided with at least a first arcuate portion 660 which is orientated to define a concave surface 661 proximal to the burner 30. In this way the handle bends towards the burner 30 at the first arcuate portion 660. The first arcuate portion is desirably provided at the handle at a position such that when the parasol dish 40 is in a non-elevated position—such as that shown in FIG. 7—the first arcuate portion 660 is coincident with an edge portion 741 of the burner 30.

To bring the grip portion 640 closer to the longitudinal axis X-X' a second arcuate portion 670 may be provided on the handle such that the handle has first and second bends. The second arcuate portion 670 also desirably defines a concave surface 671 proximal to the heater such that the handle bends again towards the heater.

The handle desirably has a plurality of mating pins 701, 702, 703, 704 provided at defined locations along the length of the handle. The mating pins are provided to couple with a mating socket 710 which is provided at the opposite side of the burner 40 to the coupling mount 607. The mating socket defines a channel 711 within which mating pins may be received. On receipt therein, the mating pins engage with the socket and serve to maintain the handle at that position. As the handle is coupled to the dish 40, on engagement of the mating pins with the socket, the dish will also be supported and retained in its position. By providing a plurality of mating pins, the dish 40 may be moved between a plurality of defined positions relative to the burner. The number of pins employed and their relative spacing to one another may be used to determine the number of positions within which the dish may be moved. To move the dish from one position to another, the user moves the handle 620 to disengage the mating pin from its socket and then directs the handle upwardly or downwardly, as appropriate, to select another position.

Figure 1:
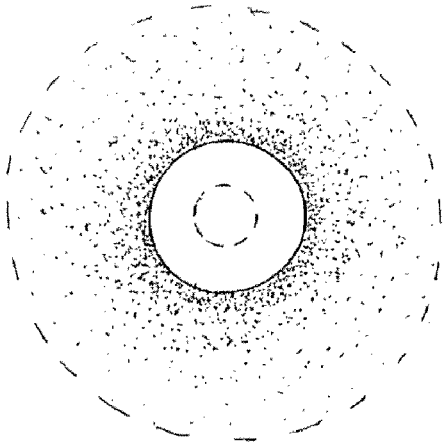
FIG. 1 (PRIOR ART)
FIG. 1 is a plan view from above of a conventional parasol heater with a non-tilting parasol dish, showing the reflected heat footprint around the base.
Figure 2:
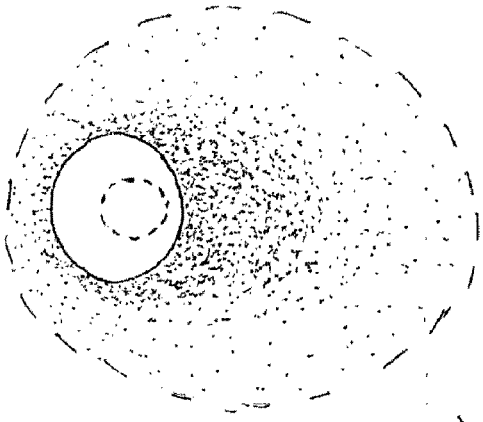
FIG. 2 (PRIOR ART)
FIG. 2 is a plan view from above of a prior art parasol heater with simple hinged tilting parasol dish, fully tilted, showing the reflected heat footprint around the base and slightly to one side of the base.
Figure 3:
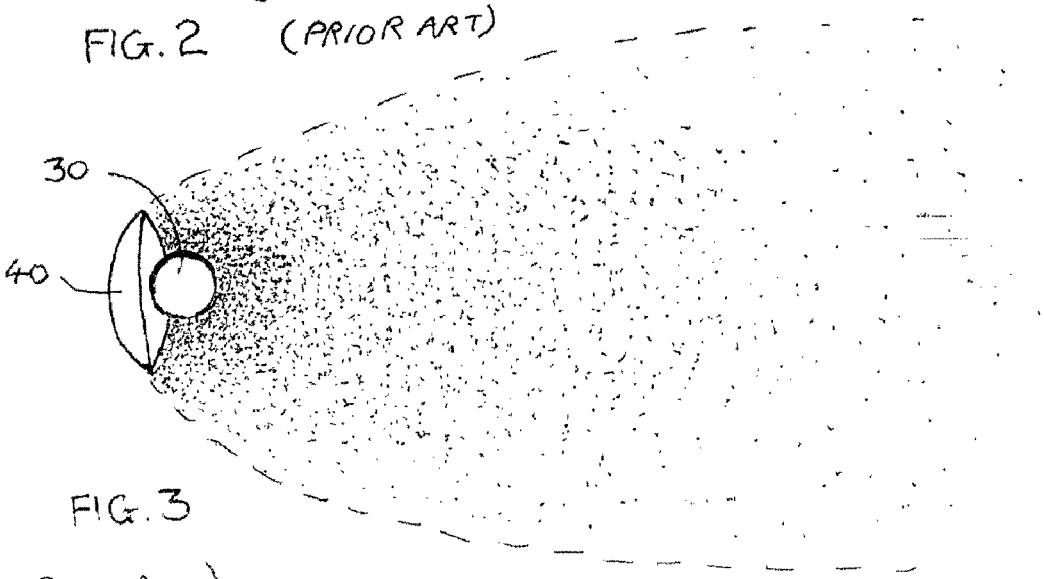
FIG. 3 (PRIOR ART)
FIG. 3 is a plan view from above of a prior art parasol heater with a tilting parasol dish in, fully tilted, showing the parabolic reflected heat footprint to one side of the base.

The number of defined locations to which the dish may be retained is more limited than is achievable using a screw mechanism but this arrangement is advantageous in that it is more reliable than using the screw mechanism. It does not suffer from heat expansion and as such the dish may be moved during use of the heater. Any corrosion of parts does not affect the ability to move the dish. The handle provides a direct lever that allows for a pivoting of the dish about a fulcrum and this direct movement is particularly reliable. The present inventors have found that by providing a distinct number of coupling points between the handle and the heater that many of the practical locations where the parasol could be usefully located relative to the burner can be facilitated This range of angles is desirably such that at full tilt, the dish is disposed at an angle of about 30° to 90°, preferably about 45° to 60°, so as to reflect heat downwardly to one side, and preferably completely to one side, of the base 10 in a parabola, as seen in FIG. 3. This provides the advantage of a much greater area of the reflected heat footprint. Also because of the greater tilt angle which can be achieved, the warm glow of the burner can be seen reflected in the dish when tilted, by a person standing beside the heater.

The present invention is not limited to the four-point linkage embodiment described above. A three-point linkage, six-point or eight-point linkage or any combination of more than two linked hinges, sliding linkages, expandable or spring-loaded linkages and straight, curved or crank links is within the scope of the improved tilting mechanism for a parasol heater dish in accordance with the present invention, in which the tilting mechanism is adapted to move the whole parasol dish in an arc relative to the top of the radiant heater element, or top of the structure, both laterally over the top of the radiant heater element and downwards over a side edge of the radiant heater element, about more than one axis of rotation.

Figure 8:
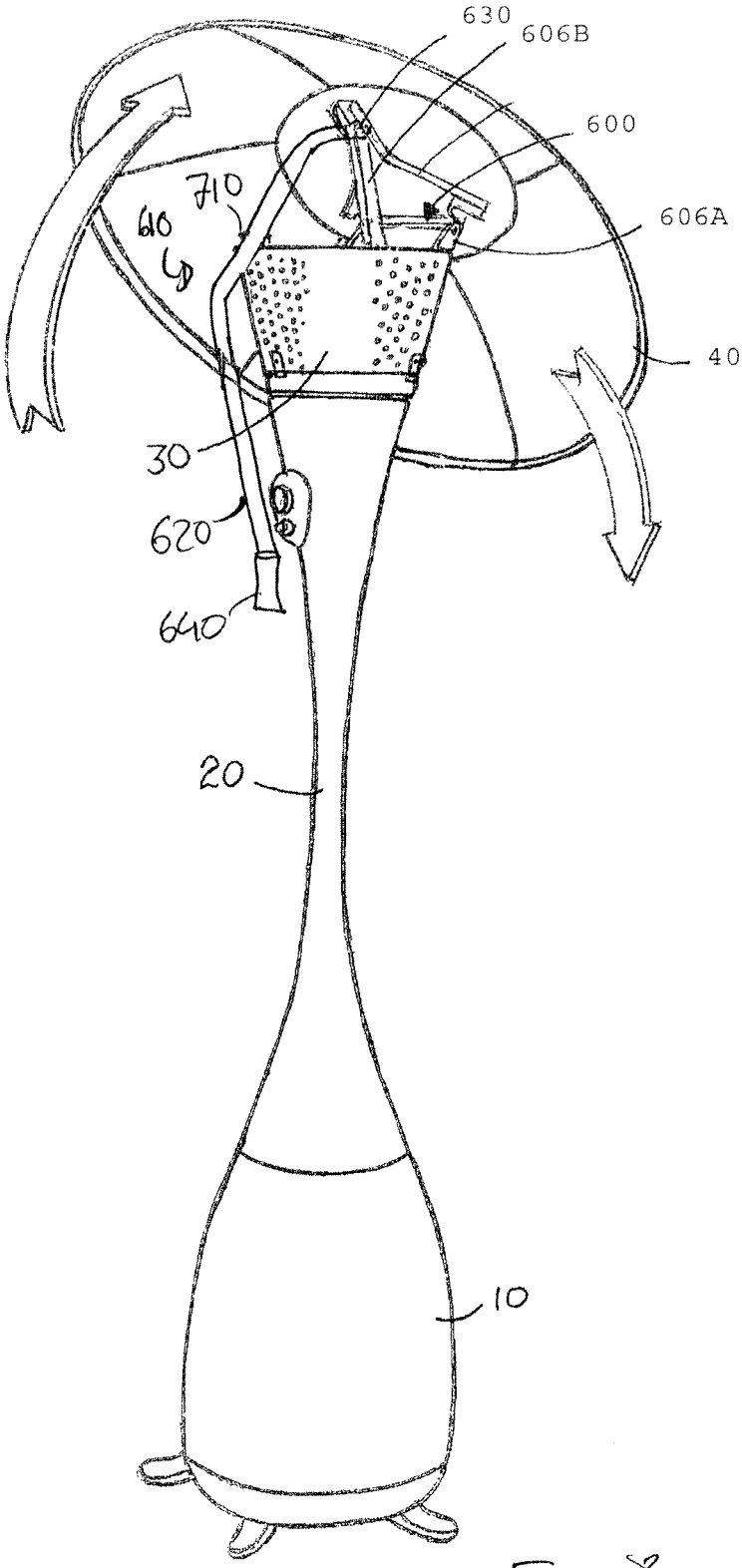
FIG. 8 is a perspective view of a parasol heater in accordance with the present teaching whereby a handle is provided on the opposite side of the burner to the tilting mechanism.

It will be understood that what has been described herein is a tilting mechanism that allows the parasol which is controlled by the mechanism to move downwards and to the side of the burner. In this way the burner may be maintained at a focal point of the dish. In an analogous art this can be compared to car headlights where a parabolic mirror is used in combination with a bulb to efficiently direct the light to a desired location. In the context of the present invention, the burner is located at the focal point of the parasol, such that heat that is generated by the burner is predominately directed in a preferred direction—as defined by the shape of the parasol. The tilting mechanism in more than one axis ensures that as the parasol dish is moved downwardly and to the side of the burner and that appropriate burner/dish distances are maintained to ensure that the heat is focused as required. As is evident from an examination of FIG. 3, this provides a highly targeted heat source, which is advantageous for a number of reasons. These include the fact that heat output from the burner can be used to heat a more concentrated area. Furthermore, no longer does the parasol heater have to be located at the centre of a gathering—rather it can be located to one side and the heat can be thrown down or deflected on the group below as desired. This is particularly advantageous for environments such as those outside public houses where it is preferred to locate the heaters to a side of the gathering of people as opposed to within. Furthermore, by reducing the amount of heat that is spilt over the top of the parasol and lost to the environment, it also means that the burner does not have to be operated at its highest levels, thereby reducing the carbon emissions and being more environmentally friendly. By providing a handle that biases the dish towards different relative position from an opposing side of the burner to the pivot point of the dish, it is possible to provide for controlled movement of the dish to distinct fixed positions. The action of the handle is a direct action onto the dish and is convenient and also reliable. As shown in FIG. 8 which uses reference numerals previously identified for specific integers, the handle 620 extends downwardly from the dish 40 along a side of the burner 30 which is opposite to that of the coupling of the dish to the burner.

It will be appreciated that what has been described herein are exemplary arrangements of a parasol heater that includes an actuator that allows a user to move the dish relative to a burner element of the heater, so as to allow for targeted heating around the heater. The actuator has been described in the context of a non-ratchet based arrangement that extends over and above the burner and also along a side of the burner to allow the user to grasp the actuator to drive the parasol dish to a desired location. It will be appreciated that modifications can be made to that described herein without departing from the spirit and or scope of the present invention and that the teaching is to be limited only insofar as is deemed necessary in the light of the appended claims which follow.

The words comprises/comprising when used in this specification are to specify the presence of stated features, integers, steps or components but does not preclude the presence or addition of one or more other features, integers, steps, components or groups thereof.

The invention claimed is:

1. A parasol heater comprising a base portion, a shaft portion, a radiant heat element and a parasol dish located above the radiant heat element, wherein the parasol dish is adapted to be tilted relative to the top of the radiant heat element, the parasol dish being pivotably connected to the radiant heat element by a pivot coupling which is adapted to allow the parasol dish to move in an arc over a side edge of the radiant heat element, the heater comprising an actuator coupled to the dish and extending over the radiant heat element, whereby in use movement of the actuator effects a corresponding movement of the dish through the pivot coupling to one or more predefined locations between a non-elevated position and an elevated position so as to allow for targeted reflection of heat from the radiant heat element, the actuator comprising a handle having first and second bends, the first bend being provided at a location coincident with an edge portion of the radiant heat element in the non-elevated position and the second bend being provided at a location configured to be proximate to an edge portion of the radiant heat element in the elevated position, and wherein the actuator biases the movement of the dish from a position above the pivot coupling of the parasol dish to the radiant heat element.

2. The parasol heater of claim 1 wherein the pivot coupling comprises a mounting providing a first hinge mounting connected to the top of the radiant heat element, a second hinge mounting connected to the underside of the parasol dish, and a movable linkage connecting the first hinge mounting to the second hinge mounting.

3. The parasol heater of claim 2 wherein the first hinge mounting comprises two spaced apart hinge points and the second hinge mounting comprises two spaced apart hinge points, such that the mounting comprises a four point linkage.

4. The parasol heater of claim 1 wherein the pivot coupling is provided at a first side of the radiant heat element.

5. The parasol heater of claim 4 wherein the actuator may be secured to the heater at a second side of the radiant heat element.

6. The parasol heater of claim 1 wherein the actuator comprises a handle pivotably coupled to the dish.

7. The parasol heater of claim 6 wherein the handle extends downwardly from the dish along a side of the heater opposite to that of the coupling of the dish to the heater.

8. The parasol heater of claim 6 wherein the handle comprises a plurality of pins provided along the length of the handle so as to facilitate the securing of the handle to the heater at one or more defined positions.

9. The parasol heater of claim 8 comprising a socket arrangement provided adjacent to the radiant heater element and configured to co-operate with the plurality of pins so as to secure the handle relative to the heater.

10. The parasol heater of claim 9 wherein the socket arrangement is provided at an opposite side of the radiant heater element to the pivot coupling.

11. The parasol heater of claim 1 wherein the actuator is coupled directly to the dish.

12. The parasol heater of claim 6 wherein the handle comprises an insulated grip portion.

13. The parasol heater of claim 1 wherein the radiant heater element is a gas burner.

14. The parasol heater of claim 1 wherein the first and second bends are provided such that the handle bends towards and over the radiant heating element throughout the range of movement of the dish relative to the radiant heat element.

* * * * *